US005303921A

United States Patent [19]

Breeding

[11] Patent Number: 5,303,921

[45] Date of Patent: Apr. 19, 1994

[54] JAMMED SHUFFLE DETECTOR

[75] Inventor: John G. Breeding, St. Louis Park, Minn.

[73] Assignee: Shuffle Master, Inc., Eden Prairie, Minn.

[21] Appl. No.: 999,001

[22] Filed: Dec. 31, 1992

[51] Int. Cl.[5] ..... A63F 1/12

[52] U.S. Cl. ..... 273/149 R; 200/61.02; 200/61.2; 250/231.11

[58] Field of Search ..... 273/149 R; 250/229, 250/231.1, 231.11; 200/61.02, 61.20, 61.40, 61.42, 84 R

[56] References Cited

U.S. PATENT DOCUMENTS

| | | | |
|---|---|---|---|
| 130,281 | 8/1872 | Coughlin | 200/84 R X |
| 2,543,522 | 2/1951 | Cohen | 250/229 X |
| 3,235,741 | 2/1966 | Plaisance | 250/229 |
| 3,949,219 | 4/1976 | Crouse | 250/229 |
| 3,968,364 | 7/1976 | Miller | 250/231.1 X |
| 4,374,309 | 2/1983 | Walton | 200/61.42 |
| 4,513,969 | 4/1985 | Samsel, Jr. | 273/149 R |
| 4,515,367 | 5/1985 | Howard | 273/149 R |
| 4,586,712 | 5/1986 | Lorber et al. | 273/149 R |
| 4,667,959 | 5/1987 | Pfeiffer et al. | 273/149 R |
| 4,807,884 | 2/1989 | Breeding | 273/149 R |
| 4,904,830 | 2/1990 | Rizzuto | 200/84 R |

*Primary Examiner*—Paul E. Shapiro
*Attorney, Agent, or Firm*—Dorsey & Whitney

[57] ABSTRACT

The present invention provides a floating jammed shuffle detector for use in a card shuffling machine. The detector has a body with a card contacting portion and a sensor interactive portion. A detector housing and a photosensor are provided. The sensor interactive portion has an aperture of a predetermined size. The detector, particularly the body, is reciprocally mounted in the housing, whereby the card contacting portion of the detector contacts the uppermost card of a deck of cards and the sensor interactive portion is received in the photosensor. Depending on the sensed position of the card contacting portion of the detector, the machine receives a reshuffle or proceed command.

15 Claims, 3 Drawing Sheets

JAMMED SHUFFLE DETECTOR

TECHNICAL FIELD

The present invention relates to devices for shuffling playing cards. In particular, it relates to an automatic mechanical or electromechanical device for shuffling playing cards, wherein the device is provided with a jammed shuffle detector.

BACKGROUND OF THE INVENTION

Wagering games based on the outcome of randomly generated or selected symbols are well known. Such games are widely played in gambling casinos and include card games wherein the symbols may be the usual, common playing cards. Card games such as black jack, Pai Gow poker, Caribbean Stud TM poker and others are excellent card games for use in casinos. Desirable attributes of casino card games are that they are exciting, that they can be learned and understood easily by players, and that they move or can be played rapidly to their wager-resolving outcome.

The desired attributes of wagering card games, particularly for those being used in casinos, have lead to the development of electromechanical or mechanical card shuffling devices. Such devices increase the speed of shuffling and dealing, thereby increasing playing time, adding to the excitement of the game while reducing the time the dealer or house has to spend in preparing to play a game.

U.S. Pat. Nos. 4,513,969 (to Samsel, Jr.) and 4,515,367 (to Howard) disclose automatic card shufflers. The Samsel, Jr. patent discloses the use of microphotosensors to detect the presence or absence of a card or cards while shuffling is proceeding. For example, when a photosensor detects the absence of a card in a dispensing compartment, a signal is transmitted to a timer circuit which then causes the energization of a solenoid to extract a card from a storage compartment. The Howard patent discloses the use of a lamp (or LED) that directs light toward a light sensitive element, whereby the light rays are blocked when a stack of cards reaches a particular height. The blockage or non-blockage of the light either energizes or turns off components of the machine to deliver cards from one portion of the machine to another. Neither of the Samsel, Jr. or Howard patents discloses a jammed shuffle detecting feature.

U.S. Pat. No. 4,586,712 (to Lorber, et al.) discloses an automatic shuffling apparatus directed toward reducing the dead time generated when a casino dealer manually has to shuffle multiple decks of playing cards. The Lorber, et al. apparatus has a container, a storage device for storing shuffled playing cards, a removing device and an inserting device for intermixing the playing cards in the container, a dealing shoe and supplying means for supplying the shuffled playing cards from the storage device to the dealing shoe. The apparatus is designed to intermix discarded playing cards into undealt decks under the program control of a computer, and includes a card jam light indicator for monitoring the passage, i.e., the presence or absence, of cards in various portions of the machine. If various photocells don't detect the passage of a card, the card jam light is automatically or manually lit and an error procedure is undertaken. The error procedure involves manually removing a jammed card and/or verifying a no error status by undertaking a microcomputer check of the status of spaces in the apparatus.

U.S. Pat. No. 4,807,884 (issued to John G. Breeding, the inventor of the present invention, and commonly owned) discloses an apparatus for automatically shuffling a deck of cards. The device includes a deck stacking zone, a carriage section for separating a deck into two portions, a sloped mechanism positioned between adjacent corners of the separated deck, and an apparatus for snapping the cards over the sloped mechanism thereby interleaving the cards. The Breeding patent is directed to providing a mechanized card shuffler whereby a deck may be shuffled often and yet the dealer still has adequate time to operate the game. Additionally, the Breeding shuffling device is directed to reducing the chance that cards become marked as they are shuffled and to keeping the cards in view constantly while they are being shuffled.

Although the Breeding card shuffling device provides a significant improvement in card shuffling devices, one unaddressed problem is that as the cards are interleaved, the interleaving edges may abut and become steepled or jammed. Jamming may occur more frequently if the cards are shuffled, handled by players, and reshuffled many times as is the case with cards used in casino gambling.

Accordingly, there is a need for a simple, durable, efficient means to monitor the shuffling procedure in a card shuffling device and, if a jam or error situation is detected, to signal the device to undertake automatic jam-correcting measures.

SUMMARY OF THE INVENTION

The problem outlined above is in large measure solved by the apparatus for detecting a jammed shuffle in accordance with the present invention.

An improved playing card shuffling machine is provided for randomly shuffling playing cards. The improvement comprises a floating jam detector having a body with a card deck contacting portion. The body has a sensor interactive portion provided with an aperture of a predetermined size. A detector housing and an optical photosensor are provided. The detector is reciprocally mounted in the housing, whereby the card deck contacting portion of the detector contacts the upper surface of a deck of cards being shuffled, and whereby the sensor interactive portion is adjacent to the photosensor. Depending on the sensed position of the body, particularly the card deck contacting portion, the machine receives a reshuffle or proceed command.

An object of the present invention is to provide a jammed shuffle detector for use in automatic mechanical or electromechanical card shuffling devices.

Another object of the present invention is to improve the card shuffling device disclosed in U.S. Pat. No. 4,807,884 (invented by the inventor of the present invention, and commonly owned) by providing a jammed shuffle detector for detecting a jammed shuffle and for signalling the device to repeat the shuffle, as well as for signalling a dealer that manual intervention is required if the repeated shuffle was ineffective in curing the jam.

An important advantage of the present invention is that it makes automatic shuffling machines more efficient and facilitates their use in casinos.

Yet another object of the present invention is to minimize edge-to-edge contact of playing cards being shuffled in an automatic shuffling machine by providing a sensor and a detector body mounted adjacent to the cards being shuffled, wherein the detector body includes a portion carried by the cards as they are being shuffled, and a portion for cooperating with the sensor to produce a status signal, the duration of the status signal or lack thereof providing an indication that the shuffle is proceeding normally or is jammed.

The preferred embodiment of the jammed shuffle detector of the present invention is designed for use with an automatic card shuffling device similar to that disclosed in U.S. Pat. No. 4,807,884, the disclosure of which patent is incorporated herein by reference. The disclosed device is operated to repeatedly shuffle a deck of playing cards, then deposit the shuffled deck into a dealing module or shoe. The device includes a zone into which a deck of cards may be deposited initially. A carriage section provides a mechanism for separating the deck into two deck portions and rotating the two portions to an angular relationship with a corner of each in close proximity. A mandrel member is driven upwardly, raising or riffling the adjacent corners and interleaving the cards. The card deck portions are aligned and pushed together to provide a single, randomly shuffled deck. The device is adapted to move repeatedly through this outlined sequence, and includes the detector of the present invention.

A portion of the detector is carried by the upper card forming the upper surface of one of the deck portions, thereby moving the rest of the detector in a generally reciprocating vertical movement as the cards are riffled and interleaved by the mandrel. The movement of the detector as the cards are being riffled periodically interrupts a generally horizontal light beam produced by a photosensor. The interruptions are timed and, as long as the interrupt time or dwell of the detector is within predetermined limits, the shuffle proceeds normally and is not repeated for more than the predetermined number of shuffles. If the cards jam, holding the detector body in an upper, interrupt position breaking the beam of light for longer than a predetermined time, the detector signals the shuffling machine to cause the mandrel to cycle through a number of re-riffle attempts so the cards interleaf normally, whereupon the detector body drops down and the light beam is not interrupted. The shuffle continues in accordance with the program.

Other objects and advantages of the present invention will become more fully apparent and understood with reference to the following specification and to the appended drawings and claims.

DETAILED DESCRIPTION OF THE PREFERRED EMBODIMENT

Figure 1:
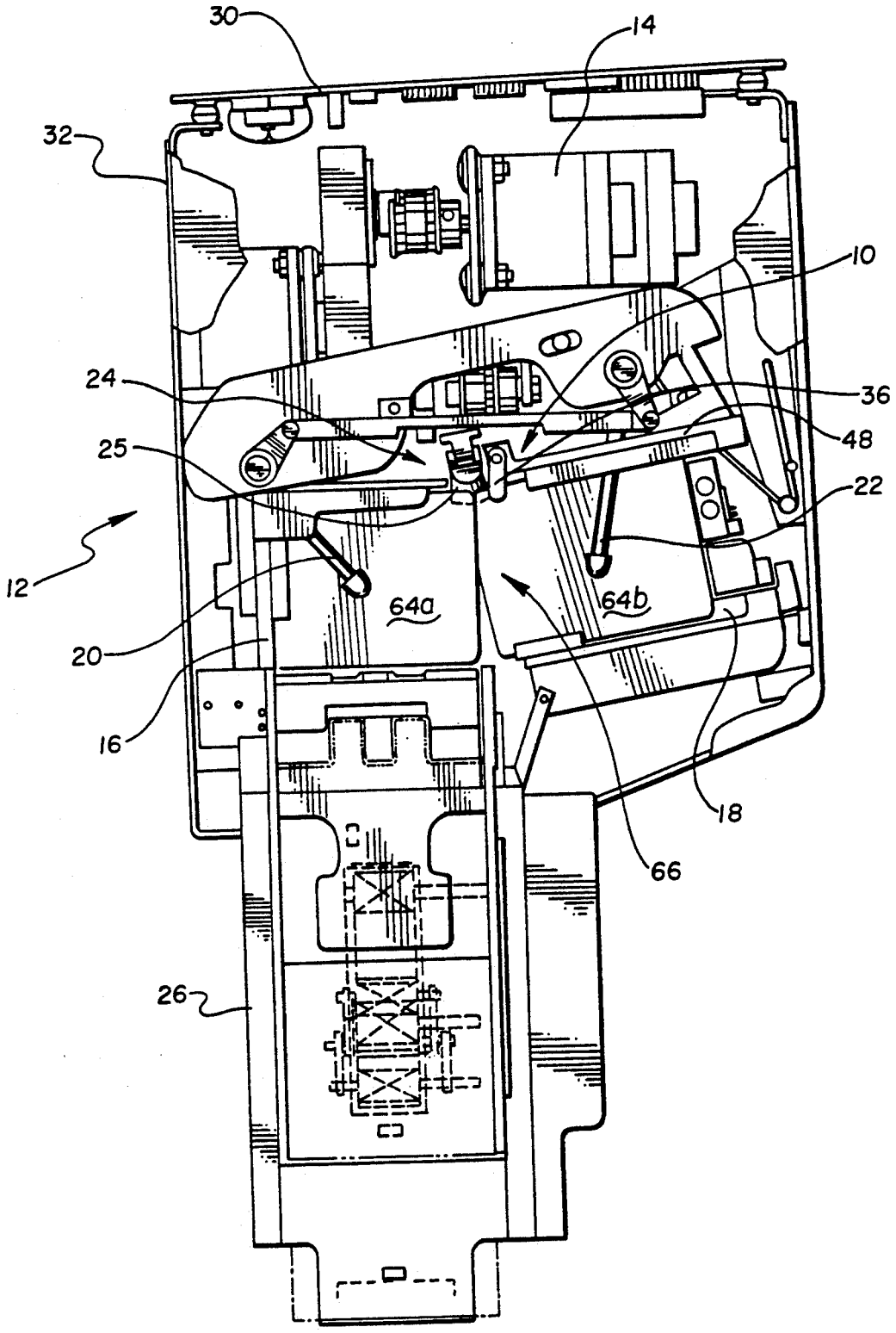
FIG. 1 is a top plan view of a shuffling machine with portions cut away for clarity, and including the jammed shuffle detector of the present invention.

Referring to FIG. 1, the jammed shuffle detector assembly 10 of the present invention is depicted in use with a shuffling machine 12. The shuffling machine 12 includes at least one low speed synchronous motor 14 for providing actuating power for the moving parts of the shuffling machine 12 with high precision and low speed rotation. Only one motor 14 is depicted in FIG. 1, but the shuffling machine 12 may be equipped with as many motors 14 as required. Appropriate motors may be selected from those such as the VEXTA synchronous motors manufactured by the Oriental Motor Co., Ltd. of Japan, particularly the VEXTA model 2 CSMGK-101.

The machine 12 includes a first card deck shuffling station assembly 16 and a second card deck shuffling station assembly 18. Each assembly 16, 18 includes a mechanical hold-down thumb 20, 22, respectively. The machine 12 has a shuffling assembly 24, including a reciprocating shuffling mandrel or blade 25 positioned generally between the shuffling station assemblies 16, 18. An optional dealing module 26 is operatively connected to the machine 12. A computer or microprocessor control circuit board 30 is provided at the rear of the housing 32 of the machine 12 to monitor and control all functions thereof.

Figure 2:
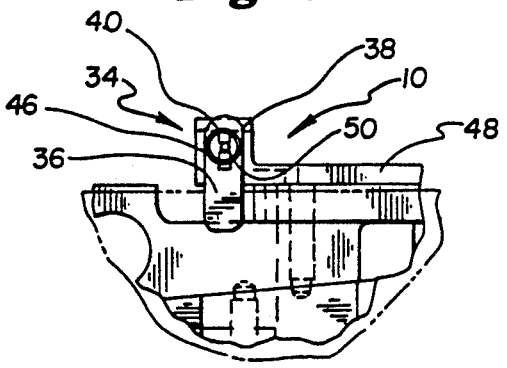
FIG. 2 is a fragmentary, enlarged top plan view of the detector of the present invention.
Figure 4:
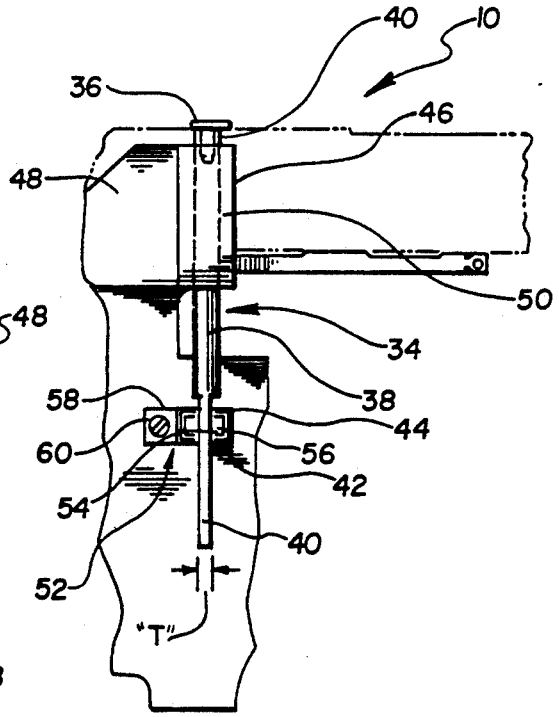
FIG. 4 is a fragmentary front elevational view of the present invention.
Figure 5:
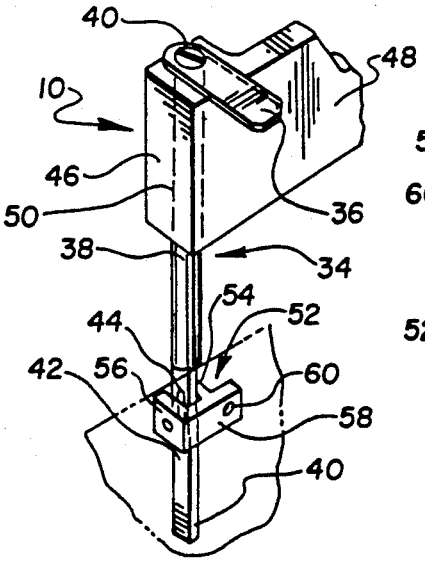
FIG. 5 is a fragmentary perspective of the present invention.

Referring to FIGS. 2, 4, and 5, the generally T-shaped jammed shuffle detector assembly 10 of the present invention includes a generally T-shaped sensor body, indicated generally at 34. The body 34 includes a flat uppermost, deck or card-contacting, generally horizontal sensor blade-like arm 36. The arm 36 is mounted on an elongated, generally cylindrical upright sensor shank 38 by appropriate means such as flathead screw 40. Other suitable well known connection means might be used to secure the sensor arm 36 to the shank 38.

The shank 38 has a free tailing end 40 opposite the end carrying the arm 36. A relieved shank portion 42 extends along the shank 38 from the free end 40 toward the end that the arm 36 is connected to. The relieved portion 42 extends for approximately ⅓ of the length of the sensor body 34 and is generally rectangular with two opposed, flattened sides, a width "W" (FIG. 3) approximately equal to the diameter of the generally cylindrical part of the shank 38, and a thickness "T" (FIG. 4) of about ⅓ of said diameter. Between the lower tailing end 40 and the cylindrical portion of the shank 38, the relieved portion 42 of the shank 38 includes an aperture or slot 44.

Referring to FIGS. 4 and 5, the detector assembly 10 includes an upper detector housing 46 attached to the side guide 48 of the deck assembly 18. The housing 46 is provided with a cylindrical complimentary bore 50 for receiving the upper, generally cylindrical portion of the sensor shank 38. The detector assembly 10 also includes a lower photomicrosensor and housing 52 for receiving the tailing end and relieved portions 40, 42, respectively, of the sensor shank 38. In the preferred embodiment of the present invention, the lower sensor and housing 52 is a slot sensor of the type represented by the "Omron" model EE-SX1023-W1, and includes an emitter side 54 and a receptor side 56. A mounting flange 58 carrying a mounting hole 60 is provided for mounting the sensor and housing 52.

Although the sensor body 34 is depicted with a cylindrical shank 38 and a flattened tailing end portion 40, other configurations are possible as long as the sensor body 34 is free to move, specifically reciprocate, in the lower and upper housings 52, 46, respectively. Additionally, the length or diameter of the slot-like opening 44 can be adjusted to an acceptable size to provide the desired degree of sensitivity to jammed shuffles, as long as the detector 10 is sensitive enough to pick up jams caused by only the uppermost two cards of the deck portions 64*a*, 64*b* depicted in FIG. 1.

Figure 3:
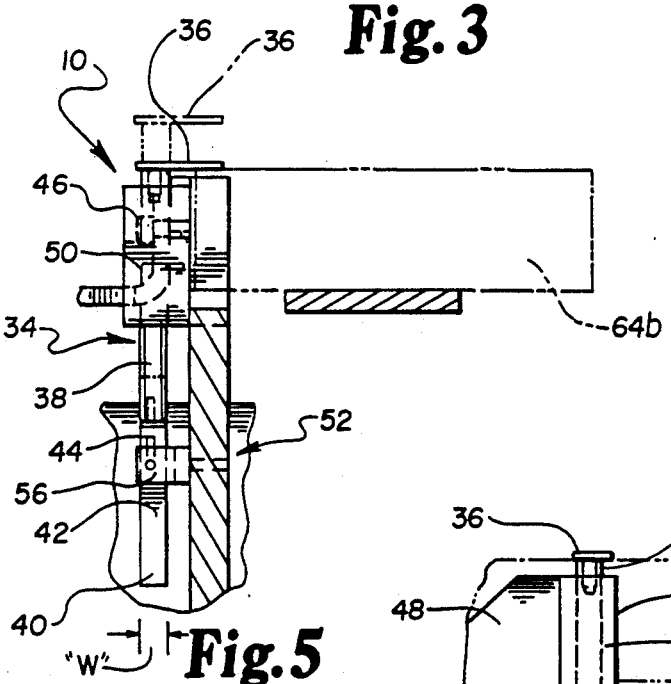
FIG. 3 is a left side fragmentary elevational view of the jammed shuffle detector depicting its range of motion.

FIG. 3 depicts the motion of the detector assembly 10 of the present invention and, in particular, shows the relationship between the photomicrosensor and housing 52 and the slot or opening 44 in the tailing end 40 of the sensor shank 38. One of the two deck portions 64*a*, 64*b*, specifically deck portion 64*b*, formed by the machine 12 from a single, unshuffled deck of cards as outlined above, is depicted in phantom, as are the positions or range of motion achieved by the detector assembly 10 of the present invention.

Referring to FIGS. 1 and 3, in use, as shuffling proceeds in the machine 12, the shuffling mandrel or blade 25 is driven upwardly toward the bottom of the two deck portions 64*a*, 64*b*. As the mandrel 25 is driven upwardly, the cards are riffled or pushed upwardly at the junction of the two deck portions 64*a*, 64*b* as shown at 66 in FIG. 1. Because the detector arm 36 floats on or is carried by the top surface of one of the deck portions 64*a*, 64*b* near the area at which the mandrel 25 lifts the cards, the upward movement of the cards raises the sensor body 34 upwardly and parallel to the side guide 48 to a higher position.

Referring to FIGS. 3 and 5, raising the sensor body 34 withdraws the slot 44 upwardly out from the light beam emitted by the photomicrosensor 52 into a position wherein the tailing end 40 of the sensor shank 38 is imposed between the sensor emitter 54 and the sensor receptor 56. If the deck of cards 64*b* is held or jammed in one of the raised positions depicted in FIG. 3, the tailing end 40 of the sensor shank 38 continues to interrupt the light emitted by the photomicrosensor 52. After a certain period of time has elapsed, as clocked and monitored by the microprocessor 30 to which the sensor assembly 10 is electronically linked (linkage not shown, but typical), the controlling microprocessor 30 signals the shuffling assembly 24 to raise the shuffling mandrel 25 again in an attempt to free the edge-to-edge jamming holding the cards in one of the raised positions depicted in FIG. 3. This may be repeated as many times as required until the cards of both decks 64*a* and 64*b* drop back to their generally horizontal, proper shuffled position: lying substantially face-to-face in each deck 64*a*, 64*b*, but with adjacent corners (as depicted in FIG. 1) interleaved.

The overall range of movement of the reciprocating sensor body 34 is approximately ¼ of an inch, but this may be varied depending on a number of factors such as the thickness of the cards, the specifications of the selected photomicrosensor or the observed frequency of jamming. Typically, an appropriate range of motion corresponds to about the thickness of about eight to thirteen common playing cards.

Figure 6:
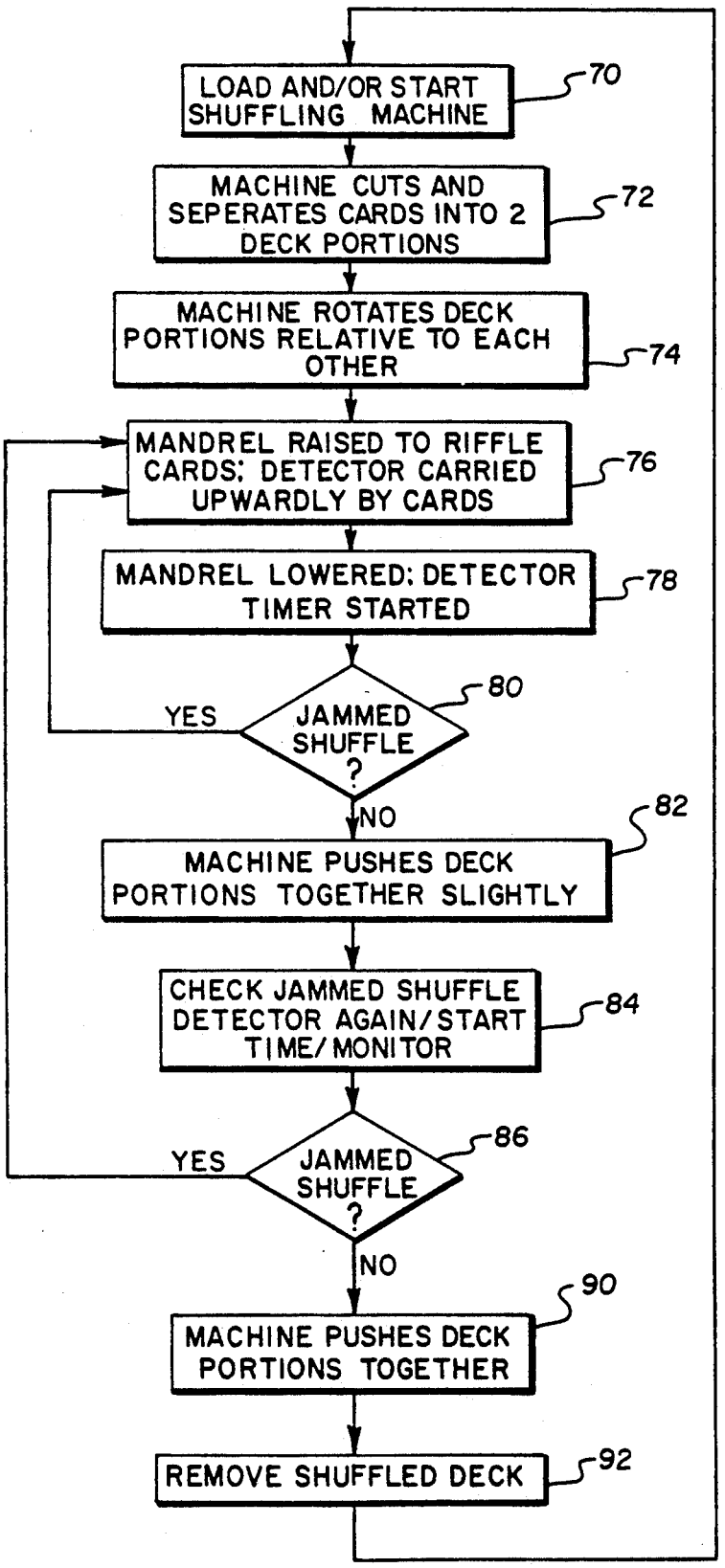
FIG. 6 is a simplified program flow diagram representing the operation of the shuffling machine and the jammed shuffle detector of the present invention.

FIG. 6 represents the operational flow of the shuffling apparatus 12 and, more particularly, the jammed shuffle detector 10 of the present invention. Block 70 represents the initial loading and/or starting of the shuffling machine 12. Typically, a dealer or operator places an unshuffled deck of cards in the first or "A" deck assembly 16 and the machine 12 is started. Flow proceeds to block 72 wherein the shuffling machine 12 cuts and separates the deck of cards into two deck portions 64*a*, 64*b*, one located in the "A" deck assembly 16 and the other in the "B" deck assembly 18, respectively. The machine 12 then rotates the deck portions 64*a*, 64*b* relative to each other, bringing the corners of the cards adjacent the shuffling assembly 24 into close proximity to each other as depicted in FIG. 1. The shuffling mandrel or blade 25 is raised at block 76 and the sensor body 34 is carried upwardly as the mandrel 25 raises the corners of the cards. Block 78 represents the lowering of the mandrel, the consequential lowering of the cards, and the initiation of the detector timer. Block 80 is a decision block wherein a jammed detector, raised to one of the interrupt positions depicted in FIG. 3, is held up by cards that failed to interleave. If the jam state is recognized at block 80, the program flow returns to block 76 wherein the mandrel 25 is reactivated to elevate and riffle the corners of the cards again in an attempt to release the jam. If, at decision block 80, the detector 10 has been raised and subsequently dropped by properly interleaving cards back to its lower noninterrupt position, wherein the photomicrosensor 52 emits and receives the light beam, program flow is directed to block 82, and the shuffling machine 12 pushes the deck portions 64*a*, 64*b* together slightly. At block 84, the jammed shuffle detector 10 is again monitored and the timer started. The reason is that the slight pushing together of the decks 64*a*, 64*b* may have caused a jam, raising the cards to one of the raised positions depicted in FIG. 3. If this has occurred, i.e., if the sensor body 34 has been carried upwardly and remains up for more than a predetermined time, at decision block 86 program flow is returned to block 76, the mandrel 25 being operated again to attempt to relieve the jam. If, at decision block 86, the sensor body 34 has returned to a lowered position wherein the light beam is uninterrupted, program flow proceeds to block 90 and the machine pushes the deck portions 64*a*, 64*b* fully together. At block 92 the shuffled deck may be removed from the machine 12 either automatically into the dealing module 26 or by hand to be distributed card players. Program flow then returns to block 70, the machine being ready to shuffle another deck of cards.

FIG. 6 is intended to depict a representative, standard set of program choices, and it should be understood that other functions, choices, limits and parameters could be programmed easily into the depicted program.

Instead of a reciprocating jammed shuffle detector assembly 10, having a generally T-shaped body 34 carrying a substantially rigid arm 36, the detector assembly 10 might comprise a flexible blade or arm with a free end and a second end fixedly attached to the side guide 48. Another modified detector assembly 10 might utilize an arm similar to, but longer than arm 36 and not necessarily flat, wherein the modified arm would have a free end and a second end pivotally connected to the side guide 48 or other structure of the machine 12 so that the free end would float with the upper surface of one of the deck portions 64*a*, 64*b*. Also, although the detector assembly 10 is depicted (FIG. 1) as offset to one side of the shuffling assembly 24, specifically, the mandrel 25, it may be located anywhere suitable as long as the rise and fall of the cards as they are being riffled can be monitored. For example, the arm 36 may be positioned directly over or more closely adjacent to the top of the interleaving corners of the cards.

In another modified alternative embodiment of the present invention, a digital position sensor, such as those manufactured by Honeywell as model No. SS1, might be used to communicate the position of the sensor body 34 directly to the microprocessor 30.

The present invention may be embodied in other specific forms without departing from the essential spirit or attributes thereof. It is therefore desired that the described embodiments be considered as illustrative, not restrictive, reference being made to the appended claims to indicate the scope of the invention.

What is claimed is:

1. A shuffling machine for shuffling playing cards and a jammed shuffle detecting means for detecting a jammed shuffle, wherein said machine includes means for separating a deck of playing cards into at least two deck portions, and wherein said jammed shuffle detecting means comprises means for determining the location of an uppermost card of one of said two deck portions.

2. A shuffling machine for shuffling playing cards and a jammed shuffle detecting means for detecting a jammed shuffle, wherein said shuffling machine comprises:

a carriage means for receiving a deck of cards, separating the deck into two deck portions, relatively rotating the deck portions to and from an angular relationship with a corner of each in close proximity, and for urging the deck portions generally toward each other; and mandrel means for riffling the adjacent corners while said deck portions are being urged toward each other thereby interleaving the cards, wherein said jammed shuffle detecting means comprises:

a card contacting means for contacting an uppermost card of the playing cards being shuffled by said machine; and sensing means for sensing the position of said card contacting means.

3. The shuffling machine according to claim 2, wherein said card contacting means comprises a generally vertical shank having a first end and a second end, a generally horizontal arm being attached to the first end and extending generally laterally away from said shank, said second end being adapted to interact with said sensing means.

4. The shuffling machine according to claim 3, wherein said card contacting means generally reciprocates vertically as said mandrel means riffles said playing cards.

5. The shuffling machine according to claim 3, wherein said sensing means comprises a photosensor.

6. The shuffling machine of claim 2 and means responsive to the jammed shuffle sensing means for actuating the mandrel means to re-riffling the adjacent corners of the cards to interleave the cards thereby clearing a jammed shuffle.

7. The shuffling machine of claim 6 wherein said card contacting means includes an arm, said sensing means being operably interactive with said arm for sensing the position of said arm.

8. The shuffling machine of claim 7 wherein said arm is connected to a generally vertical shank having a first end and a second end, said arm being connected to the first end and extending generally laterally away from said shank, said second end being adapted to interact with said sensing means.

9. The shuffling machine according to claim 8, wherein said sensing means comprises a photosensor.

10. A shuffling machine for shuffling playing cards comprising:

means for separating the deck into a pair of deck portions;

means for moving one of said deck portions to a position at an angle to the other deck portion;

means for elevating an adjacent corner of each of said deck portions and releasing said corners to interleaf said pair of deck portions; and a jammed shuffle detector comprising means for determining the location of the uppermost card of one of said pair of deck portions.

11. The shuffling machine of claim 10 and means responsive to the jammed shuffle sensing means for actuating the elevating means to re-release the adjacent corners of the cards to interleave the cards thereby clearing a jammed shuffle.

12. The shuffling machine of claim 11 wherein said jammed shuffle detector further comprises card contacting means for contacting an uppermost card of playing cards being shuffled by said machine, and sensing means for sensing the position of said card contacting means.

13. The shuffling machine of claim 12 wherein said card contacting means includes an arm, said sensing means being operably interactive with said arm for sensing the position of said arm.

14. The shuffling machine of claim 13 wherein said arm is connected to a generally vertical shank having a first end and a second end, said arm being connected to the first end and extending generally laterally away from said shank, said second end being adapted to interact with said sensing means.

15. The shuffling machine of claim 14 wherein said sensing means comprises a photosensor.

* * * * *